US010487591B2

(12) United States Patent
Schumacher et al.

(10) Patent No.: US 10,487,591 B2
(45) Date of Patent: Nov. 26, 2019

(54) CARRIAGE FOR A DISPLACEMENT HAMMER FOR POSITIONING THE DISPLACEMENT HAMMER IN A LAUNCH PIT, DRILLING SYSTEM WITH A DISPLACEMENT HAMMER AND A CARRIAGE FOR POSITIONING THE DISPLACEMENT HAMMER IN A LAUNCH PIT AND A METHOD FOR POSITIONING A DISPLACEMENT HAMMER IN A LAUNCH PIT

(71) Applicant: TRACTO-TECHNIK GmbH & Co. KG, Lennestadt (DE)

(72) Inventors: Philipp Schumacher, Lennestadt (DE); Gerhard Völkel, Erndtebrück (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 254 days.

(21) Appl. No.: 15/472,824

(22) Filed: Mar. 29, 2017

(65) Prior Publication Data

US 2017/0292333 A1 Oct. 12, 2017

(30) Foreign Application Priority Data

Apr. 7, 2016 (DE) ..... 10 2016 003 995

(51) Int. Cl.

| | |
|---|---|
| ***E21B 15/04*** | (2006.01) |
| ***E21B 12/00*** | (2006.01) |
| ***E21B 4/14*** | (2006.01) |
| ***E21B 7/04*** | (2006.01) |
| ***E21B 7/26*** | (2006.01) |

(52) U.S. Cl.

CPC ..... *E21B 12/00* (2013.01); *E21B 4/14* (2013.01); *E21B 7/046* (2013.01); *E21B 7/26* (2013.01); *E21B 15/04* (2013.01)

(58) Field of Classification Search

CPC ... E21B 7/26; E21B 7/046; E21B 4/14; E21B 15/00; E21B 15/04; E21B 12/00

See application file for complete search history.

(56) References Cited

FOREIGN PATENT DOCUMENTS

| | | | | | |
|---|---|---|---|---|---|
| DE | 2814915 | A1 | | 10/1978 | |
| DE | 10143909 | A1 | | 4/2003 | |
| DE | 102011101442 | | * | 11/2012 | ..... E21B 7/26 |
| DE | 102011101442 | A1 | | 11/2012 | |
| EP | 2487322 | A1 | | 8/2012 | |
| GB | 2488026 | A | * | 3/2012 | ..... E21B 7/20 |
| NL | 8501041 | A | | 11/1986 | |

* cited by examiner

*Primary Examiner* — David Carroll
(74) *Attorney, Agent, or Firm* — Howard IP Law Group

(57) ABSTRACT

A framework for a displacement hammer is configured for positioning the displacement hammer in a launch pit. The framework has two holding fixtures, each holding fixture having a clamp. The clamps and the holding fixtures can be moved independently from each other.

20 Claims, 5 Drawing Sheets

CARRIAGE FOR A DISPLACEMENT HAMMER FOR POSITIONING THE DISPLACEMENT HAMMER IN A LAUNCH PIT, DRILLING SYSTEM WITH A DISPLACEMENT HAMMER AND A CARRIAGE FOR POSITIONING THE DISPLACEMENT HAMMER IN A LAUNCH PIT AND A METHOD FOR POSITIONING A DISPLACEMENT HAMMER IN A LAUNCH PIT

CROSS-REFERENCE TO RELATED APPLICATIONS

This application claims priority pursuant to 35 U.S.C. 119(a)-(d) to German Application No. 10 2016 003 995.7 filed Apr. 7, 2016, the entire contents of which is incorporated herein by reference for all purposes.

FIELD OF THE INVENTION

The invention concerns a carriage for a displacement hammer for positioning the displacement hammer in a launch pit, a drilling system with a displacement hammer and a carriage for positioning the displacement hammer in a launch pit and a method for positioning a displacement hammer in a launch pit.

BACKGROUND OF THE INVENTION

Document DE 10 2011 101 442 A1 discloses a carriage for a displacement hammer for positioning the same in a launch pit. Described is a holding fixture of the carriage, which is adjustable in height and inclination. The displacement hammer, which is disposed in the holding fixture, may be inserted into a launch pit, inclined at an adjustable angle by means of a drive at a swivel joint. To achieve this, the displacement hammer may be placed onto the holding fixture on the surface of the launch pit.

Experience has shown that the carriage described in DE 10 2011 101 442 A1 works well regarding positioning results of the displacement hammer. However, the operators using the carriage, who wish to drill into the ground using a displacement hammer, are asking for a simpler and/or more flexible operation of the carriage, which would improve the initial insertion or impact driving of the displacement hammer into the ground. Moreover, there is demand for low-maintenance carriages and/or carriages with a simple design.

SUMMARY OF THE INVENTION

The object of the invention is to provide two holding fixtures that can retain the displacement hammer and which are height-adjustable independently from each other for maneuvering the displacement hammer. Due to the varying movement of the holding fixtures it is possible to adjust the angle of the displacement hammer relative to a fixed reference line without the need to provide a separate drive for the angle adjustment, for example on a swivel joint. Thus it is not necessary to provide a mechanism or drive respectively to swivel a holding fixture, but by providing a holding fixture at two points on the displacement hammer, which are spaced apart, an inclination relative to a reference line occurs automatically through independent control of the holding fixtures. This permits a simplification of the control system for the holding fixture. The holding fixture control may be reduced to a translational motion of the holding fixtures. A control system for a controllable swivel joint is not necessary, and in particular a carriage according to the invention does not have to have a drive for rotating or turning respectively of a swivel joint. It is possible to use identical components for the guides, drives and/or sensors; however, a swivel drive can be omitted. Linear drives may be used as guides. Positioning is more stable if two holding fixtures are used.

The invention provides a carriage for a displacement hammer to position said displacement hammer in a launch pit. The carriage is provided with two holding fixtures. A holding fixture comprises clamping means for the displacement hammer. The clamping means as well as the holding fixtures may be operated separately from each other.

The term "displacement hammer" comprises a device for preparing a borehole in the ground by means of a ground displacement method. The term "displacement hammer" is synonymous for soil displacement hammer, also called an earth impact mole. In a displacement hammer, an essentially circular displacement body is driven forward by means of a main piston located inside a housing of the displacement body. The driving force is usually generated with compressed air, i.e., pneumatically, wherein the main piston, due to the applied pressure, impacts directly or indirectly on the housing of the displacement body and thus creates the energy necessary to displace the soil. The driving force may also be generated hydraulically.

The term "positioning" comprises, according to the invention, the movement of the displacement hammer, in particular for the purpose of moving the displacement hammer from a position above the soil level into a position below the soil level in the launch pit. Positioning may comprise the positioning of the displacement hammer prior to and at the beginning of creating the borehole.

The term "launch pit" includes, according to the invention, any kind of space below soil level, including excavated or existing pits. A launch pit may have an essentially circular cross-section. The diameter of a launch pit may in particular be in the range between approximately 400 mm and approximately 900 mm, in particular in the range between approximately 500 mm and approximately 800 mm. A commonly used launch pit has an approximate diameter of, for example, 600 mm. The term "launch pit" includes, according to the invention, in particular a launch pit of the so-called "keyhole method" for horizontal drilling.

The term "carriage" in terms of the invention includes any type of frame or supports that are suitable to hold and align a displacement hammer. The carriage may in particular comprise a framework, the outer contour of which is adapted to the outer dimensions of the launch pit. The carriage may comprise a framework that is disposed above the launch pit and which extends into the launch pit. In particular it may be provided that the carriage is designed to rest on the soil surface, and that a part thereof extends into the launch pit but does not rest on the bottom of the launch pit. The framework may rest on the soil and hang into the launch pit. To this end the carriage may be provided with a support that rests on a base that is arranged on the soil around the launch pit, where said base may be designed as a mounting flange. The framework may have one or a plurality of openings through which the displacement hammer may be located in the corresponding holding fixtures. This provides a sturdy construction and yet is easy to maneuver.

The arrangement of the carriage may be such that, after excavation of the launch pit, a base in form of a mounting flange is placed on the soil around or in the launch pit respectively. The base may rest on the soil and may be supported by the soil on the circumferential edge of the launch pit. To this end the base, which takes the form of a mounting flange, may be braced against the soil. The carriage may be provided with a support in form of a counter flange that is disposed in particular around the framework of the carriage or on the circumference of the framework, respectively. The support may be moved with respect to the base in particular so as to be able to adjust the destination direction of the displacement hammer that is to be inserted into the carriage. Once the destination direction is set correctly, the support may be clamped relative to the base. After adjusting the destination direction, the carriage may be adjusted in height, for example by means of four slots/slot nuts placed around the circumference in vertical direction and then fixed.

The term "holding fixture" comprises, according to the invention, a technical element on which the displacement hammer can rest, wherein the displacement hammer may be at least partially surrounded by the holding fixture along its circumference.

The term "clamping means" in terms of the invention concerns a component that is designed as a detachable connection of the displacement hammer with the holding fixture, which in particular achieves a frictional connection between displacement hammer and the clamping means. The displacement hammer may be attached to the holding fixture by the clamping means. It is in particular possible for surfaces that are oriented to each other to be moved towards each other so that the displacement hammer may be clamped circumferentially in one section. Sections of the clamping means may be brought into contact with the displacement hammer along the circumference of the displacement hammer.

In a preferred embodiment at least one holding fixture for the displacement hammer is supported freely rotating so that unobstructed swiveling of the holding fixture is possible. Through providing at least two holding fixtures, at least one of the holding fixtures can be immobilized concerning the swivel movement of the holding fixture through immobilizing the displacement hammer on the other of the two holding fixtures. The freely rotating support of one holding fixture makes it possible to save one motor or drive for adjusting a corresponding angle.

In a preferred embodiment the holding fixtures are guided in tracks that extend essentially vertical. This ensures that the holding fixtures are able to move along a predetermined path. In predetermining the path of the tracks, and the therefore known dependence or the relative position of the two tracks to each other, a connecting line between the holding fixtures can be determined, which may essentially correspond to the longitudinal direction or the center axis of the displacement hammer retained in the holding fixtures. Thus the positioning of the displacement hammer can be determined by the position of the holding fixture in the track. The track orientation may deviate from a purely vertical direction, although a purely vertical orientation of the tracks and an essentially parallel arrangement of the tracks to each other is preferred. Since the displacement hammer extends essentially in straight line, the orientation of the displacement hammer may be determined through the known position of the holding fixtures in the tracks.

In a preferred embodiment, the clamping means surrounds the displacement hammer at least partially along a circumference, wherein the position of the clamping means relative to the movement path of the holding fixtures may be chosen such that effective clamping is achieved. The clamping means may clamp the displacement hammer laterally and/or from the top and bottom along the circumference.

In a particularly preferred embodiment, a clamping means comprises a pressure chamber with a flexible wall, wherein said wall may be in contact with the displacement hammer. This may achieve an effective clamping action, which is also easy to operate and which is able to adapt to the outer contour of a displacement hammer. It is, for example, possible to choose any displacement hammer diameter and still achieve a clamping action over a certain section of the diameter of the displacement hammer.

The clamping means may comprise a pressure chamber with a flexible wall that can be brought in contact with the displacement hammer. The displacement hammer may at least in some sections be surrounded by the flexible wall, in particular at least partially around the circumference. The pressure chamber may be filled with a pressure medium, for example compressed air. A clamping means of this kind is simple in design and provides, besides the elasticity of the jacket of the pressure chamber, a rigid wall that acts as counter-bearing. The clamping means may be used for a plurality of sizes and/or shapes of displacement hammers since the elastic jacket can adapt to the outer contour of the element to be clamped. The displacement hammer may have different shapes and/or varying diameters. The displacement hammer may be surrounded by the elastic jacket along at least part of its circumference or around its entire circumference. In a preferred embodiment the rigid wall may have a tubular shape so that the clamping means is easy to manipulate and the clamping process is easy. The term "tubular" signifies an elongated hollow body, the length of which may be greater than its diameter. A tubular wall is suitable for clamping an elongated element, such as a displacement hammer, wherein the cross-section of the rigid wall may be chosen such that surplus material is avoided. The material of the rigid wall may be steel, a non-ferrous metal, plastic or similar material that exhibits a certain strength. It is particularly preferred that the counter-bearing is disposed around the jacket, so that the elastic jacket is located within the element that forms the rigid wall. The elastic jacket may have a single-layer membrane. In this instance the elastic jacket may be made from a single material. The material used for the elastic jacket may be an elastic, single or multi-layer material. The material used may in particular be a synthetic rubber, preferably nitrile rubber. NBR (Nitrile Butadiene Rubber) has the advantage to be highly resistant against oil, grease and hydrocarbons, has a favorable ageing behavior and is wear-resistant. It may also be provided that the elastic jacket is made from a laminated multilayer material so that the elastic jacket is made at least in part from a multilayer material. The elastic jacket may be attached to a rigid wall through pressure-joining.

The rigid wall may be designed as an airtight pipe, in which an elastic jacket, which takes the form of a flexible, airtight tube, is disposed. The elastic jacket may be attached to the end faces of the pipe through pressure joining with radial force elements. The elastic jacket is thus joined airtight between the rigid wall and the radial force elements, which may form an airtight pressure chamber. To facilitate the supply of a pressure medium, in particular compressed air, a pressure connection may be formed in the rigid wall that may be connected to a source for the pressure medium.

In a particularly preferred embodiment the clamping means is designed such that more than two clamping position may be set. It is, for example, possible that between the two clamping positions, where one of the two positions is the clamp release and the other of the first two positions is full immobilization so that the displacement hammer is essentially immobilized with respect to the holding fixture, a third position is adjustable in which a movement of the displacement hammer is possible in that there is friction between displacement hammer and clamping means.

In a particularly preferred embodiment a control system is provided, with which at least one holding fixture can be moved and/or the clamping means can be operated. The control system is also used to control the carriage, which is in particular remotely controlled. It is thus possible to control the carriage from above the soil surface level even if the carriage is inserted into the launch pit.

In a particularly preferred embodiment an automatic control system may be provided, with which at least one holding fixture can be moved and/or the clamping means can be operated, wherein at least one sensor is disposed on the carriage to determine the movement and/or the operation of the clamping means. A control loop may be formed with a sensor in which the actual position of the holding fixture and/or the actual position of the clamping means are determined.

The invention also provides a drilling system with a displacement hammer and a carriage for positioning said displacement hammer, wherein the carriage may be designed as described above. Two holding fixtures are provided with the carriage, each of the holding features having a clamping means, wherein the clamping means and the holding fixtures can be operated independently from each other.

The invention also provides a method for positioning the displacement hammer in a launch pit, where two holding fixtures are used for the displacement hammer, each of which is provided with a clamping means for the displacement hammer. The method comprises the step that the operation of the holding fixtures and the clamping means takes place independently from each other.

In a preferred embodiment the displacement hammer can only be clamped in one holding fixture and/or only one holding fixture can be moved. This makes an angle adjustment possible without the requirement for a drive for a swivel joint.

In a preferred embodiment the clamping of the displacement hammer is adjusted so that the displacement hammer is still able to move with the clamp activated. The clamping strength can be adjusted such that a mantle friction acts on the displacement hammer which can prevent the displacement hammer in operation to move back in forward operation and to move forward in reverse operation due to reaction forces.

Neither the above description nor the following explanations of exemplary embodiments constitute a relinquishment of certain embodiments or characteristics.

BRIEF DESCRIPTION OF THE DRAWINGS

The invention will now be explained in further detail by way of an embodiment shown in the drawings.

DETAILED DESCRIPTION

Figure 1:
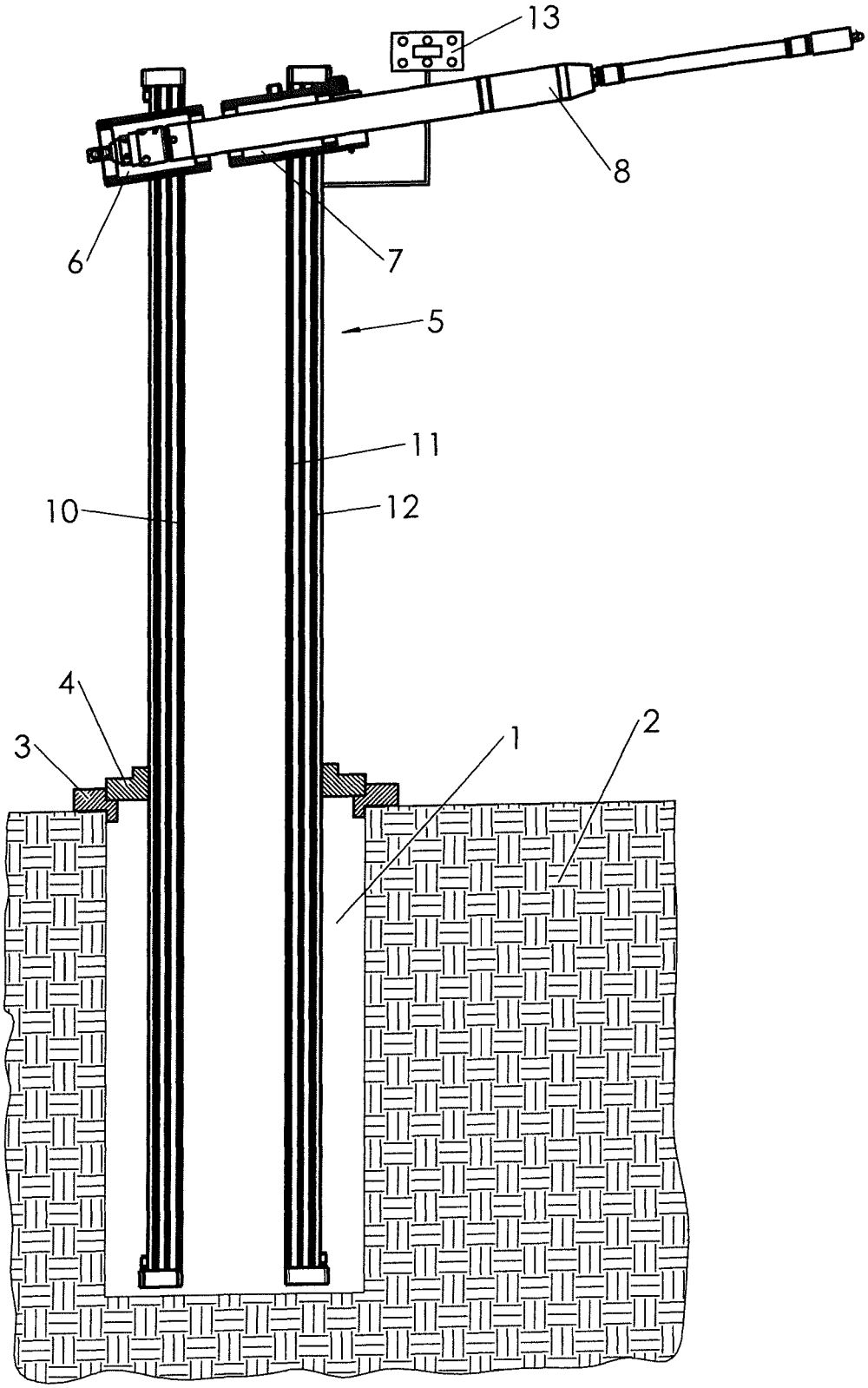
FIG. 1 shows a carriage for a displacement hammer in a state where the displacement hammer is attached to the carriage above the soil surface.

FIG. 1 depicts in partial cross-section a launch pit 1 that has been excavated from the soil 2. A base 3 is placed at the edge of the launch pit and is braced against the edge of the soil 2. The base 3 is designed as mounting flange, and the bracing of the mounting flange against the soil 2 is carried out by means of a turnbuckle with ratchet. A support 4 of a carriage 5 is placed onto the base 3. Following this, the destination direction, that is, the orientation of holding fixtures 6, 7 of the carriage 5, is adjusted in that the support 4 is rotated with respect to the base 3 and the holding fixtures 6, 7 are rotated with it. The carriage 5 is then locked with clamping brackets to base 3 and is thus fixed in the direction of the destination direction. The carriage 5 is then adjusted in height. On support 4, the carriage 5 is moved vertically via four slots/slot nuts that are distributed over the circumference in vertical direction, and then locked.

The displacement hammer 8 is inserted into the holding fixtures 6, 7. To achieve that, the holding fixtures 6, 7 are fitted with clamping means 9 in an open position, depicted in FIGS. 5*a* and 5*b*. Thus, the displacement hammer 8 may be inserted into the carriage 5 and into the holding fixtures 6, 7, respectively, above the ground surface, that is, above the soil level 2.

It is also possible to adjust the destination direction after inserting the displacement hammer 8 into the holding fixtures 6, 7. The displacement hammer 8 may be clamped into clamping means on the holding fixtures 6, 7.

A final adjustment of the destination direction is possible at any time, in particular after the displacement hammer 8 has at least partially penetrated the soil 2 at installation depth.

In order to position the displacement hammer 8 in the launch pit 1, the clamping means 9 of the front holding fixture 6 is activated and the displacement hammer 8 is clamped into the holding fixture 6. With the displacement hammer 8 clamped in that way, the front holding fixture 6 is lowered via a first track 10 until an angle $\alpha 1$ is reached with respect to an imaginary reference line, which is essentially the horizontal. The angle $\alpha 1$ may in particular be chosen such that the displacement hammer 8 can be guided through the framework 12, despite the fact that the length of the displacement hammer 8 is greater than the internal diameter of the framework 12. The result is the position of the displacement hammer 8 depicted in FIG. 2.

Figure 2:
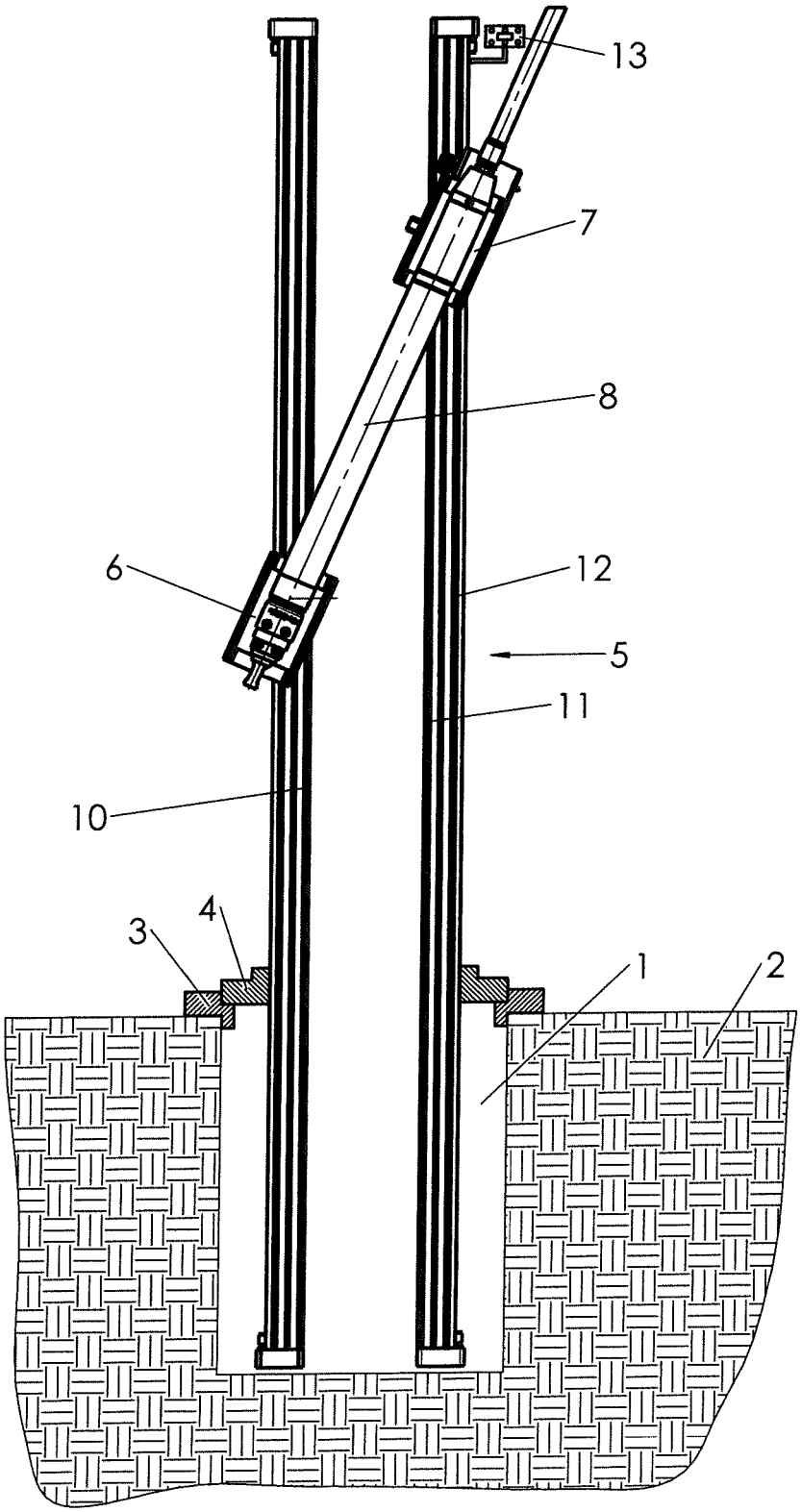
FIG. 2 shows the carriage of FIG. 1 with attached displacement hammer, wherein said displacement hammer has been swiveled into an inclined position.
Figure 3:
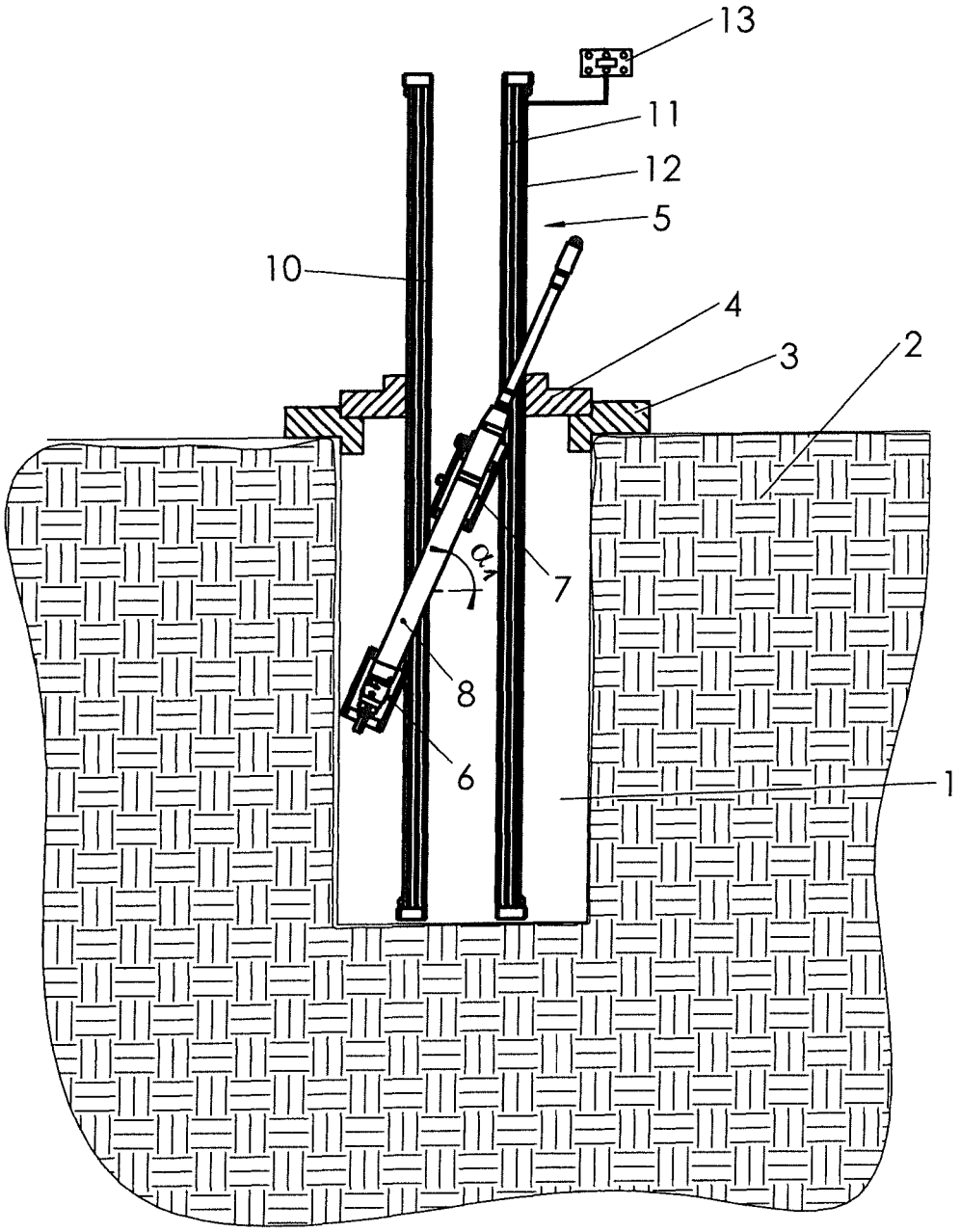
FIG. 3 shows the carriage with attached displacement hammer, where the displacement hammer has been moved below the soil surface in the inclined position of FIG. 2.
Figure 4:
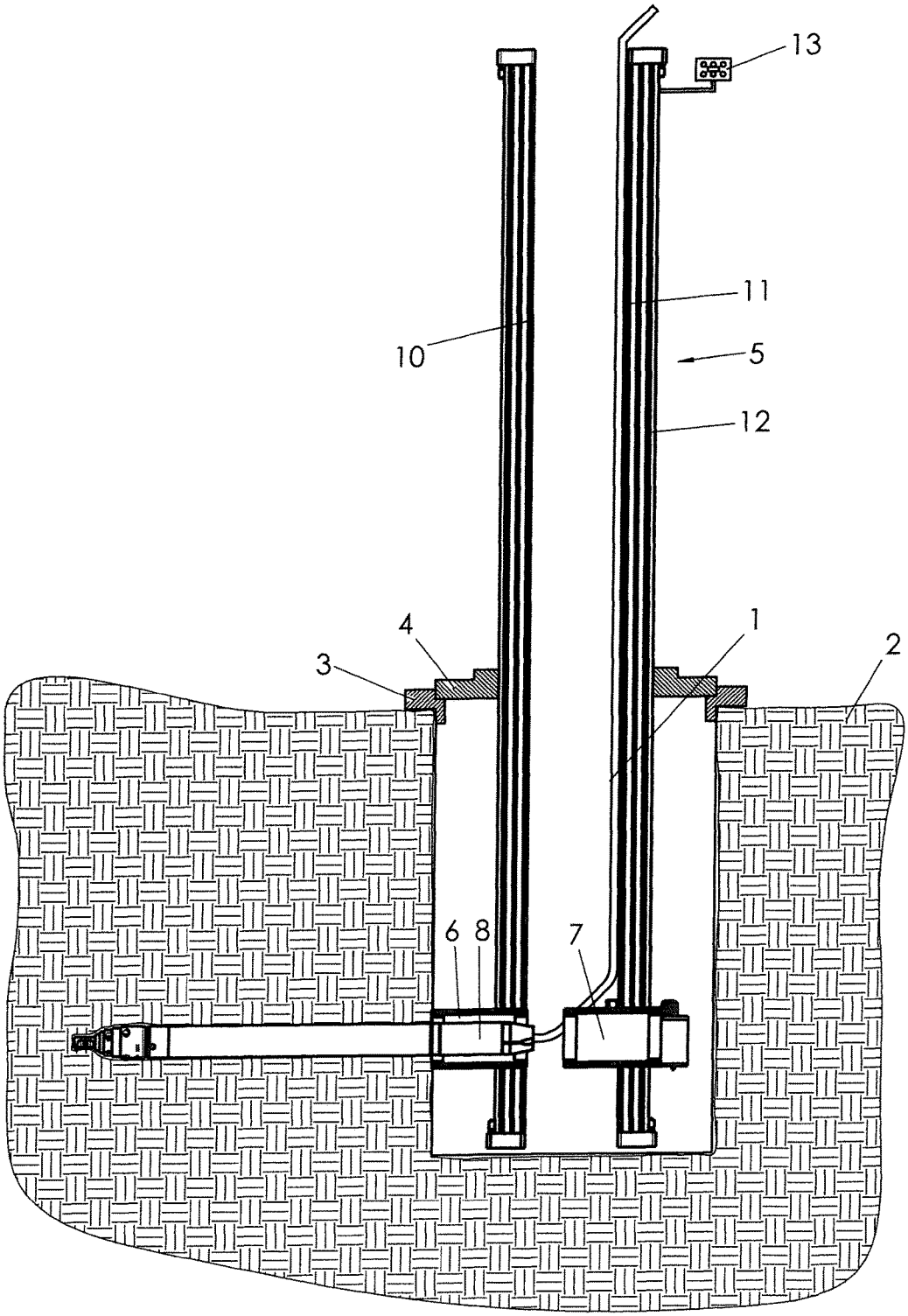
FIG. 4 shows the start of ground drilling by the displacement hammer, where the displacement hammer is essentially horizontally oriented.

Between the positions of the displacement hammer 8, shown in FIGS. 2 and 3, the holding fixtures 6, 7 are lowered whilst retaining the angle $\alpha 1$ to a point where the extension of the center line of the displacement hammer 8 reaches the penetration point for the displacement hammer 8 into the soil 2. The clamping means 9 of the front holding fixture 6 is released and the clamping means 9 of the rear holding fixture 7 is engaged so that a frictional connection to the mantle of the displacement hammer 8 is established. The mantle friction can prevent the reverse movement of the displacement hammer 8 in operation due to reactionary forces.

The displacement hammer 8 can now be started. The rear holding fixture 7 can now be lowered via a second track 11 so that the inclination angle changes continually. The inclination angle may change continually until the inclination angle for the borehole is reached. During the changing of the inclination angle, the front holding fixture 6 can be tracked in such a way that the tip of the displacement hammer 8 traces an approximate arc as it enters the soil 2, and the last inclination angle may be smaller, larger or equal to zero degrees relative to the horizontal. It is also possible to employ removal by suction. This may be achieved through a suction excavator, wherein the suction causes underwashing in the lower section of the launch pit 1. In the instance that removal by suction is employed, it is possible to first adjust the inclination of the displacement hammer 8 to the intended drilling angle and only then to start it. If the underwashing at installation depth has been completed, the exact destination direction adjustment and/or the inclination adjustment may also take place after the displacement hammer 8 has been lowered through the framework 12.

As soon as the displacement hammer 8 has reached the inclination angle ready for drilling, the displacement hammer 8, with adjusted azimuth and inclination angle, may be driven forward to a target pit. The clamping means 9 of the holding fixtures 6, 7 may be released as soon as the displacement hammer 8 has sufficient mantle friction in the soil 2, through which the displacement hammer 8 is now moving. It is possible that a pipe or a cable is pulled in from the launch pit 1 to a target pit using the displacement hammer 8.

A control system 13 is provided to drive or move respectively the holding fixtures 6, 7 in the tracks 10, 11.

As soon as the drilling is complete, the retrieval of the displacement hammer 8 may take place in reverse order of the steps described for positioning of the displacement hammer 8 prior to starting the displacement hammer. When driving the displacement hammer 8 back from the target pit to the launch pit 1, it may take with it a pipe or cable that needs to be installed, so that said pipe is pulled into the complete borehole with or without further expansion of the borehole.

Figure 5A:
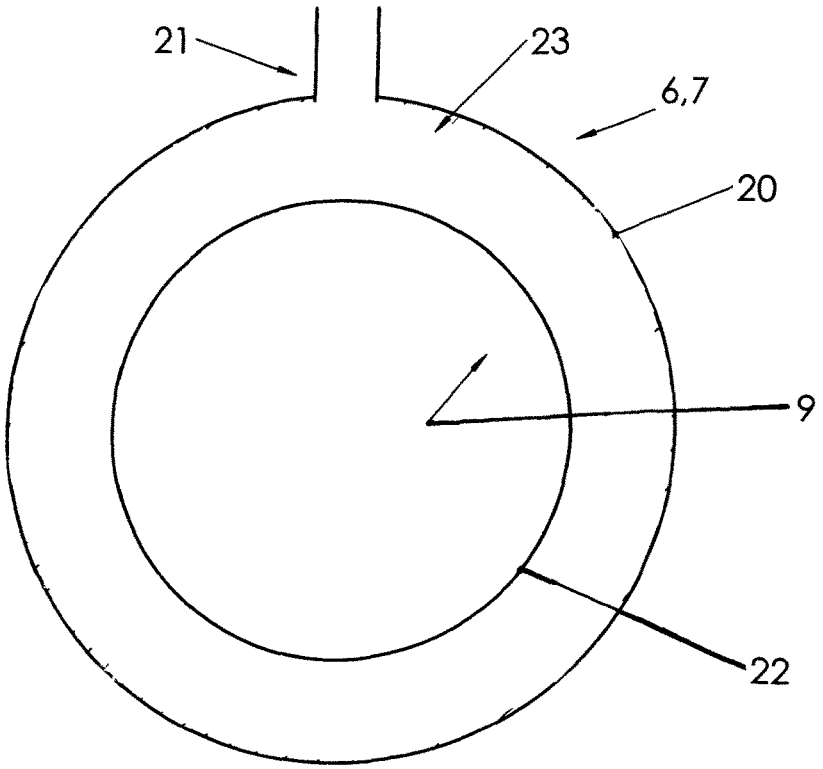
FIG. 5*a* shows a holding fixture with clamping means in partial section.

FIG. 5*a* depicts a holding fixture 6, 7 with a clamping means 9 in partial section. The clamping means 9 comprises a pressure chamber 23, which is located between a rigid wall 20 and an elastic jacket 22. A pressure means, in particular compressed air, may be supplied to the pressure chamber 23 via an opening 21 in the rigid wall 20. When pressure is applied to the pressure chamber 23, the elastic jacket 22 is able to expand towards the center of the rigid wall 20. A displacement hammer 8 that is arranged inside it transverse to the clamping means 9, that is, perpendicular to the paper plane, is at least partially clamped around the circumference of the displacement hammer.

Figure 5B:
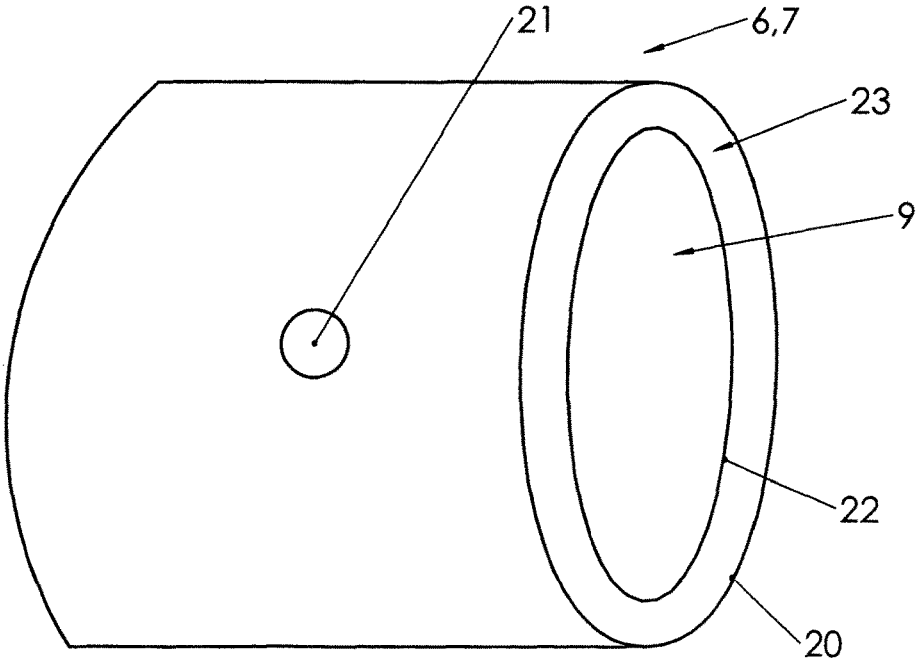
FIG. 5*b* shows the holding fixture with the clamping means of FIG. 5*a* in isometric representation.

FIG. 5*b* depicts the holding fixture 6, 7 with the clamping means 9 in isometric view.

The invention claimed is:

1. A carriage for positioning a displacement hammer in a launch pit comprising:

a first frame member configured to be disposed above the launch pit and extend into the launch pit;

a second frame member configured to be disposed above the launch pit and extend into the launch pit;

a first holding fixture configured to be movably mounted on said first frame member, said first holding fixture including a first clamp;

a second holding fixture configured to be movably mounted on said second frame member, said second holding fixture including a second clamp;

wherein the first clamp of the first holding fixture and the second clamp of the second holding fixture are configured to detachably hold the displacement hammer; and wherein each of the first holding fixture, the second holding fixture, the first clamp, and the second clamp is independently movable to adjust a position of the displacement hammer.

2. The carriage of claim 1, wherein at least one of the first holding fixture and the second holding fixture is mounted on the first frame member or second frame member by a freely swivelling joint.

3. The carriage of claim 1, wherein the first frame member comprises a first track and the second frame member comprises a second track, wherein said first holding fixture being movably mounted in the first frame member comprises the first holding fixture being mounted to move along a first predetermined path defined by the first track; and wherein the second holding fixture being movably mounted in the second frame member comprises the second holding fixture being mounted to move along a second predetermined path defined by the second track.

4. The carriage of claim 1, wherein one or both of the first clamp and the second clamp at least partially surrounds the displacement hammer.

5. The carriage of claim 1, wherein one or both of the first clamp and the second clamp comprises a rigid outer wall and a flexible inner wall which are configured to form a pressure chamber, wherein said flexible inner wall is configured to clamp the displacement hammer when pressure is applied to the pressure chamber.

6. The carriage of claim 1, wherein each of the first clamp and the second clamp is configured to operate in more than two positions.

7. The carriage of claim 6, wherein the more than two positions comprises an open clamp position for one of insertion and release of the displacement hammer, a full immobilization clamp position for immobilized clamping of the displacement hammer, and an adjustable clamp position in which friction is applied to the displacement hammer while movement of the clamp on the displacement hammer is permitted to adjust a location of the clamp on the displacement hammer.

8. The carriage of claim 3, further comprising:

at least one of a first fixture drive configured to move the first holding fixture in the first track and a second fixture drive configured to move the second holding fixture in the second track; and a control system configured to actuate one or both of the first fixture drive and the second fixture drive to move one or both of the first holding fixture and the second holding fixture.

9. The carriage of claim 8, further comprising:

at least one of a first clamp drive for setting a first clamp position and a second clamp drive for setting a second clamp position;

wherein the control system is further configured to actuate one or both of the first clamp drive and the second clamp drive to set the first clamp position and the second clamp position.

10. The carriage of claim 9, further comprising:

at least one sensor disposed on the carriage to sense (i) a movement of one or both of the first holding fixture and the second holding fixture and (ii) operation of one or both of the first clamp and the second clamp;

wherein the control system comprises an automatic control system configured to actuate the first fixture drive and the second fixture drive and to operate the first clamp drive and the second clamp drive based on movement data and operation data sensed by the at least one sensor.

11. A method for positioning a displacement hammer in a launch pit comprising:

installing framework above the launch pit and extending into the launch pit, said framework including a first frame member and a second frame member;

movably mounting a first holding fixture on said first frame member, said first holding fixture including a first clamp, said first holding fixture and said first clamp capable of independent movement;

movably mounting a second holding fixture on said second frame member, said second holding fixture including a second clamp, said second holding fixture and said second clamp capable of independent movement;

clamping the displacement hammer with one or both of the first clamp of the first holding fixture and the second clamp of the second holding fixture; and independently operating one or more of the first holding fixture, the second holding fixture, the first clamp, and the second clamp to adjust a position of the displacement hammer in the launch pit.

12. The method of claim 11, wherein clamping the displacement hammer with one or both of the first clamp of the first holding fixture and the second clamp of the second holding fixture comprises clamping the displacement hammer with only one of the first clamp and the second clamp; and further comprising moving the corresponding one of the first holding fixture and the second fixture to position the displacement hammer.

13. The method of claim 11, wherein clamping the displacement hammer with one or both of the first clamp of the first holding fixture and the second clamp of the second holding fixture comprises clamping the displacement hammer with only one of the first clamp and the second clamp such that the one of the first clamp and the second clamp applies friction to the displacement hammer but permits movement of the clamp on the displacement hammer to adjust a location of the clamp on the displacement hammer.

14. The method of claim 11, wherein the first frame member comprises a first track and the second frame member comprises a second track;

wherein movably mounting said first holding fixture in the first frame member comprises movably mounting the first holding fixture in the first track to move along a first predetermined path defined by the first track; and wherein movably mounting said second holding fixture in the second frame member comprises movably mounting the second holding fixture in the second track to move along a second predetermined path defined by the second track.

15. The method of claim 14, wherein independently operating one or more of the first holding fixture, the second holding fixture, the first clamp, and the second clamp to adjust the position of the displacement hammer in the launch pit comprises:

independently actuating, by a control system, one or more drives corresponding to the one or more of the first holding fixture, the second holding fixture, the first clamp, and the second clamp to adjust the position of the displacement hammer.

16. A drilling system comprising:

a displacement hammer;

frame work comprising a first frame member and a second frame member configured to be disposed above a launch pit and extend into the launch pit;

a first holding fixture configured to be movably mounted on said first frame member, said first holding fixture including a first clamp;

a second holding fixture configured to be movably mounted on said second frame member, said second holding fixture including a second clamp;

the displacement hammer detachably held by the first clamp of the first holding fixture and the second clamp of the second holding fixture; and wherein each of the first holding fixture, the second holding fixture, the first clamp, and the second clamp is independently movable to adjust a position of the displacement hammer.

17. The drilling system of claim 16, further comprising:

a base member configured to be placed on soil around or in the launch pit;

a support member configured to be disposed on the framework and the base member;

wherein the support member is movable with respect to the base member to adjust a destination direction of the displacement hammer.

18. The drilling system of claim 17, wherein wherein the base member comprises a mounting flange and the support member comprises a counterflange; and wherein the counterflange is configured to be clamped to the flange.

19. The drilling system of claim 18, wherein the framework is configured to be adjusted in height within the launch pit when the counterflange is clamped to the flange, including adjustment so that a bottom end of the framework does not contact a bottom of the launch pit.

20. The drilling system of claim 19, wherein the first frame member comprises a first track and the second frame member comprises a second track; and further comprising:

at least one of a first fixture drive configured to move the first holding fixture in the first track and a second fixture drive configured to move the second holding fixture in the second track; and a control system configured to actuate one or both of the first fixture drive and the second fixture drive to move one or both of the first holding fixture and the second holding fixture.

* * * * *